US005417163A

United States Patent [19]

Lienard

[11] Patent Number: 5,417,163

[45] Date of Patent: May 23, 1995

[54] RAILWAY BOGIE WITH FRAME HAVING SELECTIVE DEFORMABILITY

[75] Inventor: Jean M. Lienard, Ferriere-la-Petite, France

[73] Assignee: Sambre et Meuse (Societe Anonyme), Feignies, France

[21] Appl. No.: 146,089

[22] PCT Filed: May 14, 1992

[86] PCT No.: PCT/FR92/00425

§ 371 Date: Nov. 9, 1993

§ 102(e) Date: Nov. 9, 1993

[87] PCT Pub. No.: WO92/20558

PCT Pub. Date: Nov. 26, 1992

[30] Foreign Application Priority Data

May 15, 1991 [FR] France ..... 91 05873

[51] Int. Cl.[6] ..... B61F 5/00

[52] U.S. Cl. ..... 105/198.7; 105/185; 105/190.2; 105/207

[58] Field of Search ..... 105/171, 179, 185, 190.2, 105/193, 197.05, 197.2, 198.7, 207, 226

[56] References Cited

U.S. PATENT DOCUMENTS

| | | | |
|---|---|---|---|
| 339,041 | 3/1886 | Brill | 105/185 |
| 2,609,757 | 9/1952 | Blomberg | 105/198.7 |
| 2,702,512 | 2/1955 | Maatman . | |
| 2,754,768 | 7/1956 | Hile | 105/193 |
| 2,853,958 | 9/1958 | Neumann . | |
| 3,181,479 | 5/1965 | Rumsey et al. | 105/193 |
| 3,191,551 | 6/1965 | Hirst | 105/198.7 |
| 3,262,693 | 7/1966 | Hirst | 105/198.7 |
| 3,517,620 | 6/1970 | Weber | 105/198.7 |
| 3,937,153 | 2/1976 | Durocher | 105/193 |
| 3,941,063 | 3/1976 | Cope . | |
| 4,265,182 | 5/1981 | Neff et al. . | |

FOREIGN PATENT DOCUMENTS

| | | | |
|---|---|---|---|
| 1032164 | 6/1953 | France . | |
| 1265913 | 5/1961 | France | 105/193 |
| 2201999 | 5/1974 | France . | |
| 2634714 | 2/1990 | France . | |
| 2644743 | 9/1990 | France . | |
| 1405624 | 10/1968 | Germany . | |
| 0104603 | 4/1963 | Netherlands | 105/190.2 |
| 0687221 | 2/1953 | United Kingdom | 105/185 |
| 1240914 | 7/1971 | United Kingdom . | |
| 2030944 | 4/1980 | United Kingdom . | |

*Primary Examiner*—Mark T. Le
*Attorney, Agent, or Firm*—Young & Thompson

[57] ABSTRACT

Sole-bars (1) bear on axles by elastic suspensions (12) with frictional damping. The bolster (18) bears by elastic blocks (32) on the lower side of a window (24) through each sole-bar. Each elastic block (32) bears on a face (31) of the sole-bar which has, in relation to the longitudinal direction (L) of the bolster (18), an inclination (A) such that the compressive force (F) of the elastic block has a horizontal component ($F_{HT}$) which pushes the sole-bar so as to bear by its reference face (26) against a parallel reference face (28) belonging to the bolster. Thus, the sole-bars (1) are constantly returned to a favored configuration of perpendicularity in relation to the bolster. Use for effectively combatting parasitic deformations and sideways movements of deformable-frame bogies.

11 Claims, 3 Drawing Sheets

RAILWAY BOGIE WITH FRAME HAVING SELECTIVE DEFORMABILITY

FIELD OF THE INVENTION

The present invention relates to a bogie comprising two sole-bars between which extend at least two axles and, between the latter, a bolster, each end of which is joined respectively to one of the sole-bars by an articulated linkage.

BACKGROUND OF THE INVENTION

Such bogies are used for travelling over tracks in bad condition. The greatest inequalities at least are absorbed not by the clearance of a suspension between axle and sole-bar but by an equalising movement of the sole-bar in its vertical plane.

However, this type of chassis has the drawback of permitting numerous parasitic movements and, especially, movements according to which each sole-bar has the tendency continuously to overtake the other or be overtaken by it. In oscillatory mode, this type of movement leads to a sideways-motion trajectory of the assembly of the vehicle and, possibly, a derailment.

THE KNOWN PRIOR ART

Numerous examples are known, for example from U.S. Pat. Nos. 2,853,958 and 2,702,512 or FR-A-2 644 743, of such linkages which form at the same time a suspension and which comprise for this purpose springs bearing on the sole-bars. Some of these springs hold the bolster up directly. Others hold up the bolster by means of a wedge which generates a horizontal reaction used for stabilizing the suspension in various ways. These articulations are relatively complicated. The horizontal forces there are of course proportional to the load supported but, however, they are only generated by a small portion of the load supported by the bogie.

FR-A-22 01 999 relates to a wedgeless articulation. The bolster bears on the sole-bars by means of elastic blocks having an arched shape or a v-shape which tends to favour the configuration in which the two sole-bars are perpendicular to the bolster. However, the stability of the favoured configuration is very poor, especially as any deviation in relation to this configuration leads, of course, to an overcompression of a portion of the elastic blocks but also a spring back of another portion of the same elastic blocks.

A bogie is known, again from FR-A-26 34 714, in which prestressed elastic blocks act in an oblique horizontal direction in order to apply a vertical face of the bolster, opposite these blocks, against a corresponding reference face of the sole-bars, perpendicular to the longitudinal direction of the bogie. This disposition has the drawback of requiring the reference faces to lift off from each other when the sole-bar performs its equalising movement in the vertical plane in relation to the bolster. Furthermore, the return to the preferred configuration is independent of the load supported by the bogie, which is a drawback since the tendency of the bogie to assume undesirable configurations increases with the load supported by the bogie.

OBJECT OF THE INVENTION

The object of the invention is thus to provide a bogie whose sole-bars are articulated to the bolster with great freedom to perform their equalising movements in their vertical planes whilst being very effectively prevented from pivoting in the horizontal plane in relation to the said bolster.

SUMMARY OF THE INVENTION

According to the invention, the railway bogie comprising two sole-bars between which extend at least two axles and, between the latter, a bolster, each end of which is joined respectively to one of the sole-bars by a wedgeless articulated linkage which transmits the weight of the vehicle supported by the bolster to the sole-bar whilst permitting the sole-bar clearance movements in a plane perpendicular to the longitudinal direction of the bolster, is characterised in that:

a lateral reference face belonging to the sole-bar is in frictional contact with a conjugate reference face belonging to the bolster, these lateral and conjugate reference faces being transverse to the longitudinal direction of the bolster; and the articulated linkage is arranged in order that the bolster transmits, to the sole-bar, through the action of the said portion of the weight of the vehicle, a force having a horizontal component applying, one against the other, the lateral reference face and the conjugate reference face.

Thus, when the sole-bar pivots in its vertical plane, the lateral and conjugate reference faces respectively slide against each other thereby providing a frictional damping, beneficial to the stability of the trajectory. The articulation opposes this movement only with a moderate moment. By contrast, if the sole-bar undergoes lateral parasitic forces, it cannot move away from the conjugate reference face of the bolster as, in order to do this, these forces would have to exceed the horizontal component of the force due to the weight of the wagon. As this horizontal component is proportional to the weight of the wagon, the stability obtained is proportional to the load supported by the bogie.

The horizontal-component force may be obtained by bearing between bearing faces, at least one of which is oblique, preferably with interposition of an elastic block. The presence of the elastic block enables the manufacturing tolerances of the bolster and of the sole-bar to be reduced and provides a certain elastic return moment on the sole-bar. If the elastic block can be deformed easily in shear, it may be fixed to the sole-bar and to the bolster whilst enabling the sole-bar to bear laterally against the reference faces of the bolster.

Other particular features and advantages of the invention will further emerge from the description hereinafter in relation to a non-limiting example.

DETAILED DESCRIPTION OF THE INVENTION

Figure 1:
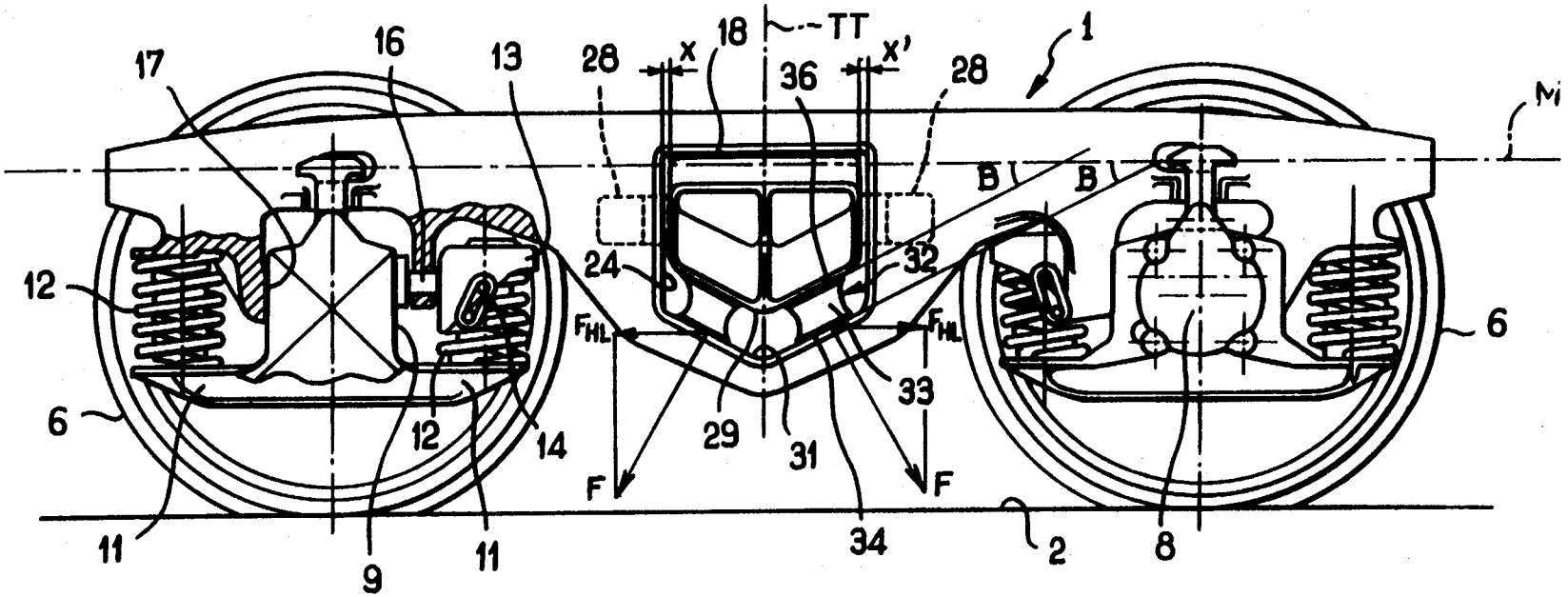
FIG. 1 is a view, in lateral elevation, of a bogie according to the invention with partial cross-section of one of the axle suspensions.
Figure 2:
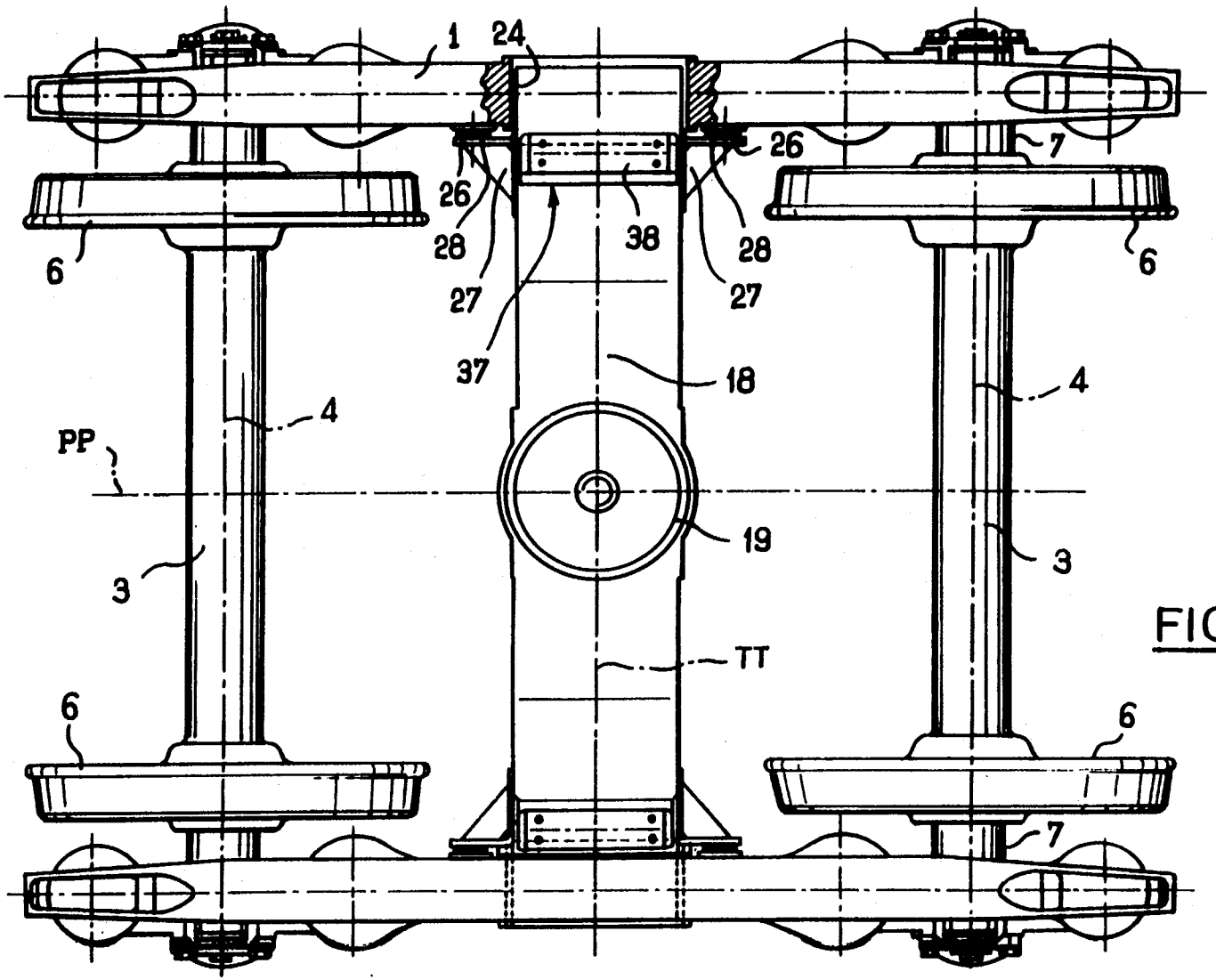
FIG. 2 is a plan view of the bogie of FIG. 1 with partial cross-section of a bolster/sole-bar articulation.

As FIGS. 1 and 2 show, the frame of the bogie comprises two lateral sole-bars 1 whose general longitudinal direction M is, at rest, parallel to the rails 2 and to a median vertical plane PP of the bogie. In the following, everything which is parallel to the plane defined by the two rails 2, which are assumed to be horizontal and parallel, will be described as horizontal and everything which is perpendicular to this plane as vertical.

The two sole-bars 1 are supported by two axles 3 whose axis 4 is perpendicular to the plane PP. The axles 3 are symmetrically disposed on either side of a median vertical transverse plane TT of the bogie. Between the sole-bars 1, each axle 3 carries two wheels 6. Beyond each wheel 6, the axles 3 have an axial extension 7 supported by a bearing 8 mounted in an axle-box 9 which is located beneath the sole-bar. The base of each axle-box 9 is extended forwards and backwards by a lug 11 extending in an approximately horizontal plane. An elastic system 12, comprising, in the example, two helical springs with a common vertical axis, bears in compression on the upper face of each lug 11. At each axle end, one of the elastic systems 12 bears directly beneath the sole-bar 1. The other elastic system 12 bears in a cap 13 which is pulled downwards by the sole-bar 1 by means of an oblique swing-link 14. Because of the obliqueness of the swing-link 14, the cap 13 undergoes a force directed obliquely downwards, the vertical component of which compresses the elastic system 12 and the horizontal component of which is transmitted to the axle-box 9 by means of a pushing device 16 which is slidably mounted in the sole-bar. The pushing device 16 bears on a lateral face of the axle-box 9 and pushes the axle-box 9 so as to bear by its opposite lateral face against a corresponding wall 17 of the sole-bar. Thus, in a known manner, during the oscillations of the suspension, the axle-box 9 rubs against the pushing device 16 and against the face 17 through a bearing force which is proportional to the state of compression of the elastic systems 12, and therefore proportional to the load supported by the axle. This produces a damping effect of the oscillations which is proportional to the load supported by the axle.

Figure 4:
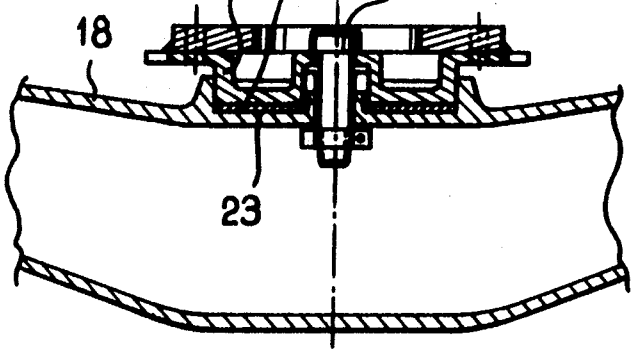
FIG. 4 is a view of a detail of FIG. 3, on a larger scale.

The sole-bars 1 are joined together, in the plane TT, by a bolster 18. The central region of the upper face of the bolster is constructed in the form of a cylindrical pivot-bearing 19 for the articulation of the bolster 18 with the body (not shown) of the wagon. As FIG. 4 shows, the pivot-bearing 19 is intended to receive a complementary cylindrical pivot 21 fixed to the lower face of the body of the wagon and connected axially to the bolster, with the possibility for rotation about the central vertical axis of the bogie, by means of a retention bolt 22. The pivot 21 bears on the bottom of the pivot-bearing 19 by means of a side friction block 23. The use of a cylindrical pivot is rendered possible as, with the bogie according to the invention, it is sufficient that the bolster 18 can pivot about a single axis in relation to the body of the wagon. It is therefore pointless having recourse to a more complicated and bulkier articulation of the spherical type.

Figure 3:
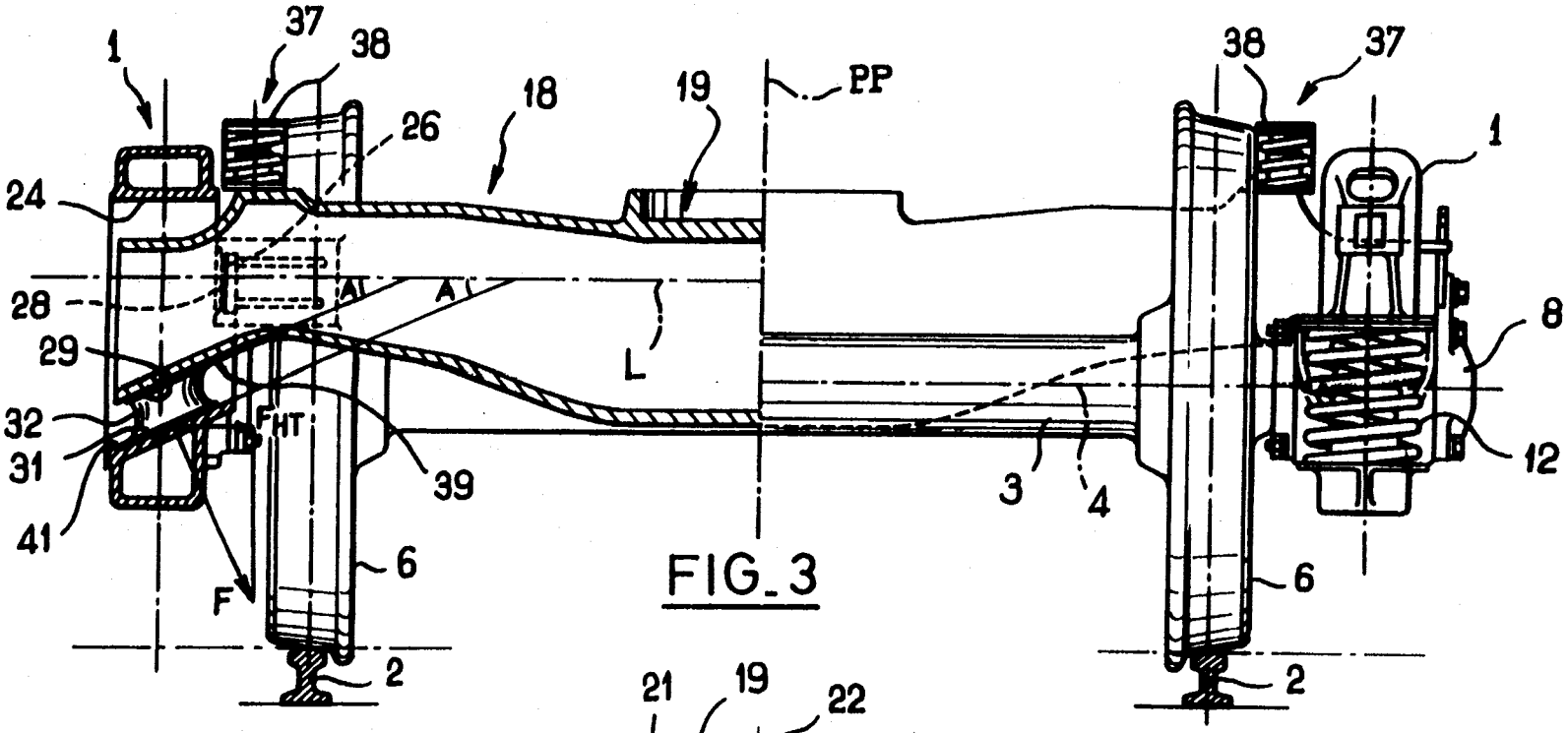
FIG. 3 is a front view of the bogie according to FIGS. 1 and 2, with transverse half-section.

As FIG. 3 shows, the bolster 18 also carries on its upper face, in the vicinity of the inner face of each sole-bar, two lateral bearing members 37 for the body of the wagon. These lateral bearing members are elastically compressible and comprise, on their upper faces, a friction lining 38 intended to bear frictionally against the lower face of the body of the wagon in order to hold up the body of the wagon at some distance away from the pivot-bearing 19 and, consequently, to eliminate the major portion of the swinging loads to which the pivot-bearing could be subjected and, at the same time, to dampen, by friction, the possible sideways movements of the bogie in relation to the body of the wagon.

Each end of the bolster 18 is engaged in a window 24 of one of the sole-bars 1. An elastic articulation is produced between the bolster 18 and the sole-bar 1 in this opening. This linkage prepositions each sole-bar in relation to the bolster 18.

In order to achieve this, each sole-bar 1 carries on its inner face, that is to say facing the other sole-bar 1, two friction linings 26 located on each side of the window 24, which define two lateral reference faces of the sole-bar which are coplanar and parallel to the plane PP. In addition, the bolster 18 carries in the vicinity of each of its ends and on each of its lateral faces a bracket 27 to which is fixed, facing respectively one of the linings 26, a friction lining 28. The friction linings 28 define on the bolster 18 two reference faces which are conjugate with those defined by the linings 26 on the sole-bar 1 and which are coplanar and perpendicular to the longitudinal direction L of the bolster 18.

Thus, when the linings 26 and 28 bear on each other, the corresponding sole-bar 1 is in an orthogonal configuration in relation to the bolster 18. In addition, if the two sole-bars 1 are in this configuration in relation to the bolster 18, neither of the sole-bars 1 is ahead of the other in relation to the direction of advance of the bogie along the rails, provided that the distribution of the clearances X and X' (FIGS. 1 and 2), which are allowed on each side of the bolster in the window 24 along the longitudinal direction M, is the same at the two ends of the bolster.

It will be noticed that each sole-bar 1 can pivot in an equalising movement about an axis parallel to the longitudinal direction L of the bolster 18 without this leading to lift-off between the friction linings 26 and 28. Such a movement requires simply sliding with friction between these linings, which plays a beneficial damping role.

Figure 5:
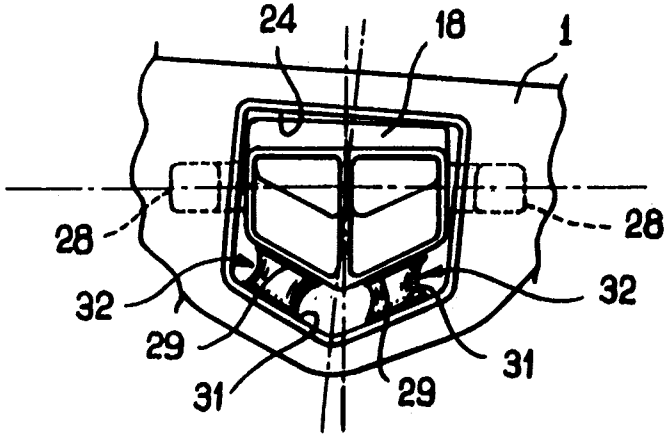
FIG. 5 is a similar view to the central portion of FIG. 1 during the working of the bolster/sole-bar elastic articulation.

Such an equalising movement is permitted by the clearances X and X' initially provided between the bolster and the front and rear walls of the window 24. This clearance then assumes a wedge shape on each side of the bolster, as FIG. 5 shows.

Furthermore, each end of the bolster 18 bears by its base against the base of the window 24, by means of two elastic blocks 32 each comprising a mass 33 of rubber or another elastomer interposed between two end plates 34 and 36.

More particularly, the base of the window comprises two faces 31 in the form of a concave dihedron, which is symmetrical in relation to the transverse plane TT, and the base of the bolster end has a complementary convex dihedral shape whose two faces 29 are, when the bogie is at rest, substantially parallel to the faces 31 of the bolster. The two elastic blocks 32 are each mounted between one of the faces 31 of the window 24 and the parallel face 29 of the bolster. Each elastic block 32 is relatively incompressible, but very flexible in terms of shear deformation such that the block 32 barely transmits forces parallel to its bearing faces. Thus the compressive forces exerted by the block 32 on each of these faces are substantially perpendicular to the latter. Each face 31 and each face 29 is inclined at an angle A (FIG. 3) in relation to the longitudinal direction L of the bolster 18. The angle A, approximately 30°, is oriented such that the compressive force F of the elastic block 32 (FIG. 3) on the corresponding face 31 of the window 24 has a horizontal component $F_{HT}$ parallel to the direction L which pushes the sole-bar 1 towards the median longitudinal plane PP and, consequently, tends to press the sole-bar by its two friction linings 26 against the two friction linings 28 which are firmly attached to the bolster 18. The face 31 is therefore directed obliquely upwards and towards the plane PP.

It will be noted that the elastic block 32 exerts on the face 29 of the bolster 18 a force having a component directed horizontally towards the outside of the bogie, but this force is balanced by an equal and opposite force exerted by the elastic blocks on which the other end of the bolster 18 bears.

Thus, the transverse horizontal component $F_{HT}$ produced by each elastic block 32 on the associated sole-bar 1 tends permanently to produce, between the linings 26 and 28 the bearing together by virtue of which the sole-bar 1 preserves its preferred configuration in relation to the bolster 18.

Furthermore, as FIG. 1 shows, the two faces 31 and the two faces 29 form an angle B of approximately 30° with the longitudinal direction M of the sole-bar 1. Taking into account the symmetry in relation to the plane TT, this inclination results in the compressive force F exerted by each elastic block 32 on the corresponding face 31 of the window 24 having a horizontal component $F_{HL}$ parallel to the longitudinal direction M of the sole-bar 1. When the clearances X and X' are equal, the two components $F_{HL}$ are equal and opposite: this is the position of stability. If the clearances X and X' are not equal, one of the elastic blocks 32 is more compressed than the other and this results in the two components $F_{HL}$ being unequal and their resultant is non zero and tends to move the sole-bar in relation to the bolster in the direction for re-establishing the equality between the clearances X and X'.

As the faces 29 and 31, between which the elastic blocks 32 are interposed, are substantially parallel to each other, the elastic blocks 32 have, a priori, no strong tendency to slide parallel to these faces under the effect of the load: such a sliding would produce no work of spring-back of the blocks 32. However, in order to preposition the blocks and to prevent parasitic movements, a stop shoulder 39 in the vicinity of the upper end of the face 29 and a stop shoulder 41 in the vicinity of the lower end of each face 31 are provided for each block 32 (FIG. 3).

In the example shown, the angle A (FIG. 3) is chosen to be 25° and the angle B (FIG. 1) is chosen to be 30°.

The rubber of the blocks 32 can have a Shore hardness equal to 50.

The dimensions (length and width) of the rubber blocks 32 are chosen to be sufficient for the blocks not to undergo an excessive compression from the bolster and the sole-bars.

In service, through the action of the load from the wagon, which load is transmitted to the pivot-bearing 19 of the central bolster 18 via the pivot 21, the bolster bears on the sole-bars 1 by means of the elastic blocks 32. The latter, under compression and shear stresses, allow a relative sliding between the bolster and each sole-bar and produce on the sole-bars, in relation to the bolster, a force whose component $F_{HT}$ (FIG. 4) applies the reference faces of both sole-bars, which faces are defined by the linings 26, against the corresponding references faces, which faces are defined by the linings 28, of the bolster 18. Under the lateral thrusts transmitted to the sole-bar by the axles, the sole-bar tends, when travelling, to have parasitic movements which would correspond to a lift-off of one of the lining pairs 26, 28, the other lining pair 26, 28, located on the other side of the bolster playing the role of a hinge. But this tendency for parasitic movement is combatted by the elastic blocks loaded by the bolster 18 and, more particularly by the component $F_{HT}$ of their compressive force F. This force is proportional to the load supported by the bolster 5, such that the stability increases with the load supported by the bogie, since this is desirable, given that the parasitic forces are themselves proportional to the load.

On the other hand, as FIG. 5 shows, the elastic blocks 32 oppose only a small return moment countering the pivoting movements of each sole-bar 1 about an axis parallel to the longitudinal direction of the bolster. During such a movement, it is generally observed that one of the elastic blocks 32 undergoes an overload, but that the other, on the contrary, helps the movement as this movement corresponds for it to a spring back. Under these conditions, the bogie according to the invention enables the two sole-bars to assume different orientations about an axis parallel to the longitudinal direction of the bolster, which enables the load to be distributed over the four wheels 6 of the bogie even when the railway track is highly deformed. All this is possible without the bolster 18 having to be inclined in relation to the body of the wagon. This is why the invention permits the use of a flat cylindrical pivot-bearing, as explained hereinabove.

During violent buffing between wagons, one of the clearances X or X' may momentarily be cancelled out and a lateral face of the bolster may come into contact with the lateral face of the window 24 located opposite. This is not a drawback, these two faces being sized in a sufficiently extensive manner in order to undergo such a shock without damage.

The invention is not limited to the example described and shown. The bolster could have in place of the surfaces 29 a single surface in the form of a cylinder sector whose generatrices would be parallel to the edge separating the surfaces 29. This cylindrical surface would bear directly, by two of its generatrices, on the surfaces 31 of the sole-bar.

It is also possible to produce the linkage between the bolster and each sole-bar by a traction connection rod or a pair of traction connection rods extending upwards and towards the outside of the bogie from the bolster to the sole-bar. This connection rod or these connection rods would transmit an oblique force whose horizontal component would push the sole-bar against the bearing linings 28 of the bolster.

I claim:

1. Railway bogie comprising two separated sole-bars (1), at least two axles (3) and a bolster (18), the axles (3) and the bolster (18) extending between the two sole-bars (1), the bolster (18) being joined to each of the sole-bars (1) by a wedgeless articulated linkage so as to transmit to the sole-bars (1) a portion of the weight of the vehicle supported by the bolster (18) and to permit the sole-bars (1) to have clearance movements in a plane perpendicular to the longitudinal direction of the bolster, each sole-bar (1) having lateral reference faces (26) and bearing faces (31), the bolster (18) having reference faces (28) and bearing faces (29) at each of its ends, said lateral reference and bearing face (26, 31) of each sole-bar (1) being parallel to a reference or bearing face (28 or 31) of the bolster (18), the bearing (29, 31) and reference (26, 28) faces being disposed transverse to the longitudinal direction (L) of the bolster, and certain of said faces being so inclined that the bolster (18) transmits to the sole-bars (1), proportionally with a force exerted by said portion of the weight of the vehicle, a generally inwardly and downwardly oriented force (F) having a horizontal component ($F_{HT}$) that urges lateral reference faces (26) of the sole-bars (1) toward reference faces (28) of the bolster (18).

2. Bogie according to claim 1, wherein each of the lateral reference faces (26) of the sole-bars (1) is in frictional contact with one of the reference faces (28) of the bolster (18).

3. Bogie according to claim 1, wherein each of the lateral reference faces (26) of the sole-bars (1) faces the other sole-bar.

4. Bogie according to claim 1, wherein the articulated linkage is arranged so as to transmit the force (F) from the bolster to each sole-bar, via a bearing member (32) along at least one bearing face (29, 31), the bearing faces being inclined at an angle (A) of about 30° to the longitudinal direction (L) of the bolster.

5. Bogie according to claim 4, wherein the bearing member (32) is an elastic block (32) interposed between cooperating bearing and conjugated bearing faces.

6. Bogie according to claim 5, wherein the elastic block is adapted to resiliently deform under the effect of shear stresses.

7. Bogie according to claim 5, wherein two elastic blocks (32) are provided at each end of the bolster (18), the blocks being mounted one beside the other in relation to the longitudinal direction (M) of the sole-bar and each block being mounted between two inclined said bearing surfaces (29, 31), the two bearing surfaces of a sole-bar and of each end of the bolster having the same inclination (A) with respect to the longitudinal direction (L) of the bolster and opposed inclinations (B) with respect to a longitudinal direction (M) of the sole-bar (1).

8. Bogie according to claim 5, wherein each elastic block (32) is mounted between two substantially parallel bearing surfaces (29, 31).

9. Bogie according to claim 1, wherein clearances (X, X') oriented substantially vertically are provided between each bolster (18) engaging end and opposing faces belonging to the sole-bar (1).

10. Bogie according to claim 1, wherein each sole-bar (1) bears on the end of each of the axles (3) by means of an elastic suspension (12).

11. Bogie according to claim 1, wherein the bolster (18) is provided with a centrally disposed device that pivotally connects the body of a wagon to the bogie, the pivoting linkage being cylindrical (19).

* * * * *